United States Patent [19]

Eberle

[11] Patent Number: 4,727,700

[45] Date of Patent: Mar. 1, 1988

[54] CEILING OR WALL HAVING IMPROVED FIRE RESISTANCE AND METHOD OF INSTALLING THE SAME

[76] Inventor: George F. Eberle, 414 Killearn La., St. Louis, Mo. 63141

[21] Appl. No.: 872,176

[22] Filed: Jun. 9, 1986

[51] Int. Cl.[4] ..... E04B 2/74; E04B 2/80; E04B 1/68

[52] U.S. Cl. ..... 52/417; 52/317; 52/410; 52/488; 52/573; 52/747; 411/368; 411/480; 411/533; 411/544

[58] Field of Search ..... 52/459–469, 52/483, 484, 364, 346, 573, 488, 489, 717, 718, 777, 105, 361, 362, 363, 417, 434, 317; 411/531, 533, 368, 369, 480, 544

[56] References Cited

U.S. PATENT DOCUMENTS

| | | | |
|---|---|---|---|
| 1,201,820 | 10/1916 | Hedden | 52/362 |
| 1,662,177 | 3/1928 | Williams | 52/348 X |
| 1,713,139 | 5/1929 | Lurie | 52/682 X |
| 1,725,787 | 8/1929 | Ellis | 52/362 |
| 1,815,065 | 7/1931 | Lucy | 52/349 |
| 1,859,779 | 5/1932 | Lee | 52/363 X |
| 1,925,774 | 9/1933 | Phillips | 52/346 |
| 1,947,954 | 2/1934 | Piland | 52/317 |
| 3,054,213 | 9/1962 | Mathues | 52/410 X |
| 3,333,379 | 8/1967 | Harris | 52/483 X |
| 3,798,865 | 3/1974 | Curtis | 52/665 |
| 4,007,570 | 2/1977 | Hunter | 52/317 |
| 4,007,571 | 2/1977 | Marchello et al. | 52/483 |
| 4,237,669 | 12/1980 | Hunter | 52/417 |
| 4,392,336 | 7/1983 | Ganssle | 52/417 |
| 4,467,581 | 8/1984 | Francovitch | 411/542 X |
| 4,606,168 | 8/1986 | Fuhrer | 52/443 X |

FOREIGN PATENT DOCUMENTS

| | | | |
|---|---|---|---|
| 204855 | 12/1956 | Australia | 52/417 |
| 682956 | 10/1938 | Fed. Rep. of Germany | 411/533 |
| 2256096 | 5/1974 | Fed. Rep. of Germany | 52/105 |

OTHER PUBLICATIONS

"Gypsum Board", Georgia-Pacific, pp. 22–24, 1975.

"Fire Resistance Design Manual", Gypsum Association, Tenth Edition, 1983, cover, pp. '–11 and 43–60.

*Primary Examiner*—Alfred C. Perham

*Attorney, Agent, or Firm*—Gravely, Lieder & Woodruff

[57] ABSTRACT

A ceiling or wall for a partition structure that contains framing members has the usual sheets of wallboard applied side-by-side to the framing members so that seams exist between the edges of adjacent sheets. Improved fire resistance is derived from runners which extend between the framing members directly behind the seams so as to serve as fire stops and as additional support for the wallboard sheets. Each runner is at its ends attached to the framing members between which it extends and further consists of several components which slip relative to each other, so that the length of the runner remains constant even though its components experience thermal expansion. This prevents the runners from bowing and pushing the wallboard sheets away from the framing members in the event of a fire. The runners further receive and anchor edge fasteners. Each edge fastener consists of a screw which passes through a seam between two sheets and threads into the runner behind that seam and also a disk which the screw draws up against the exposed surfaces of the sheets on each side of the seam. The disks, while supporting the sheets, allow the sheets to shrink without destroying their structural integrity in the region of support. A method of installing the ceiling or wall surface is also described. The runners have tabs which cause them to be located against the edge of the first sheet so as to be centered with respect to the seam when the second sheet is attached to the framing members.

25 Claims, 12 Drawing Figures

CEILING OR WALL HAVING IMPROVED FIRE RESISTANCE AND METHOD OF INSTALLING THE SAME

BACKGROUND OF THE INVENTION

The invention relates in general to partition structures for buildings and more particularly to a fire resistant ceiling or wall and method of installing the same.

Generally speaking, the area most vulnerable to a fire within a building is the ceiling directly above the fire. In the basement of a typical residential building that ceiling is usually nothing more than a series of wood floor joists over which a wood subfloor extends. When a fire develops beneath a ceiling of this construction, the flames impinge directly against the joists, setting them ablaze, and they are consumed quite rapidly, causing the floor above to collapse. Indeed, an unprotected wood joist or truss ceiling will usually fail within 10 to 12 minutes when subjected to the ASTM E119 fire test.

Ceiling constructions that include gypsum wallboard fare somewhat better, because the wallboard, being noncombustible, acts as a shield and prevents the flames from impinging directly against the wood joists—at least at the outset. Even so, a ceiling construction that includes wallboard hung in the conventional manner from joists that are spaced more than 16 inches apart, as is common in construction today, still will not pass a so-called one-hour fire test. In other words, a ceiling construction of that character, when loaded and subjected to a fire under the controlled conditions prescribed by ASTM E119, will collapse within less than one hour. The failure usually commences at the joints between the sheets of wallboard, for the intense heat destroys the bond between the joint cement and the wallboard, causing the joint cement and the tape, which is embedded in it, to fall. This opens the joint and allows the hot gases and the flames to enter the plenum normally isolated by the wallboard. The heat of the fire further drives the water of hydration from the gypsum, and as a consequence the gypsum wallboard shrinks. This opens the joints still further and thus renders the plenum region more vulnerable to the hot gases and flames. Just as significant, it causes the wallboard to draw away from the nails or screws which secure it, so that the wallboard loses its structural integrity in the regions where it is supported. As a consequence, the wallboard falls and completely exposes the wood joists to the flames.

It is not uncommon for building codes or insurance policies to require somewhat greater resistance to fire in the case of multifamily residential buildings or commercial and industrial buildings. Typically, they must pass a one-hour or longer fire test.

Several procedures exist for increasing the fire resistance of a wood joist or wood truss ceiling construction clad with wallboard. Perhaps the simplest is to merely use a double layer of wallboard, with the sheets of the lower layer being placed with their longitudinal axes oriented at 90° with respect to the longitudinal axes for the sheets of the upper layer. This almost doubles the cost of hanging the wallboard for the ceiling. Another is to erect a grid against the lower surfaces of the joists or trusses and to secure the wallboard sheets to the grid instead of directly to the joists or trusses. To be effective the grid must exist behind each joint in the wallboard ceiling, so that the joint remains blocked should the tape and joint cement fall away from it. Thus, the construction of the grid requires a considerable amount of measuring, and is likewise costly. Still another procedure is to install wood blocks behind the joints to keep the joints sealed after the loosening of the joint cement and tape, but this requires a considerable amount of additional carpentry and is also costly.

DESCRIPTION OF THE DRAWINGS

In the accompanying drawings which form part of the specification and wherein like numerals and letters refer to like parts wherever they occur

DETAILED DESCRIPTION

Figure 1:
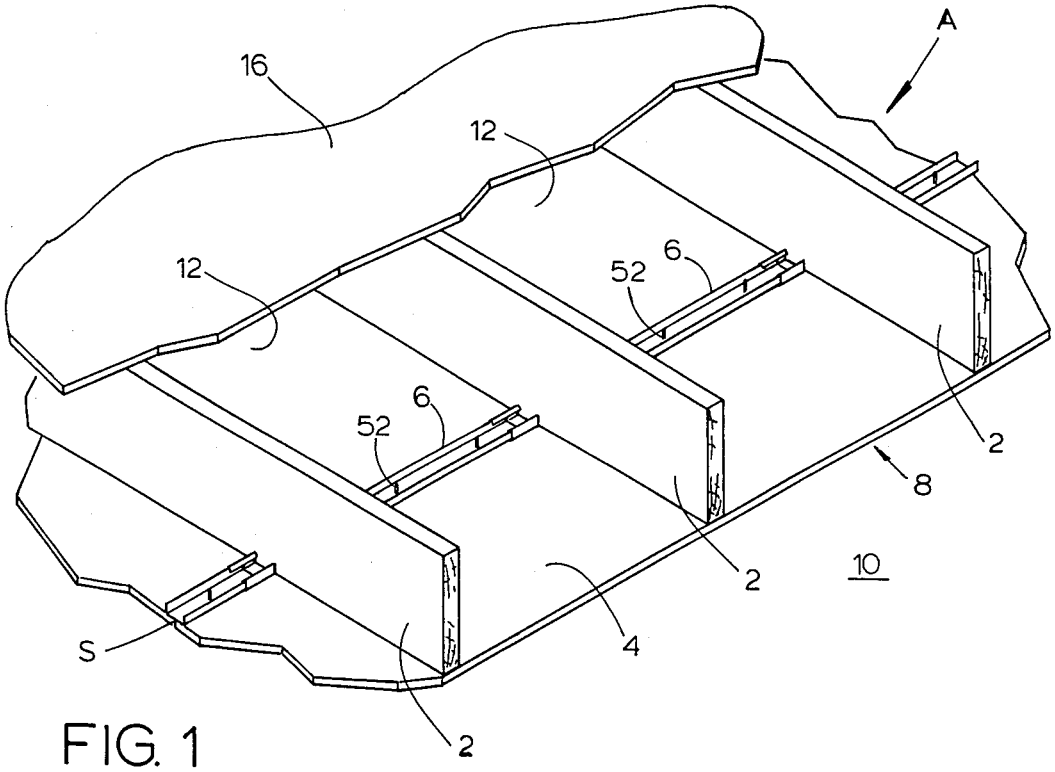
FIG. 1 is a perspective view showing the top of a fire resistant partition structure constructed in accordance with and embodying the present invention, with the deck that forms the upper surface of that structure being broken away.

Referring now to the drawings, a partition structure A (FIGS. 1 & 2) is suitable for enclosing a region of a building where fire resistance greater than that afforded by conventional construction techniques is required or desired. The partition structure A in its most basic form includes framing members 2, sheets 4 of wallboard which are attached side-by-side to the framing members 2 so that longitudinal seams S exist between adjacent sheets, and runners 6 which bridge the spaces between adjacent framing members 2 and lie immediately behind the seams S. The several sheets 4 of wallboard provide a uniform and continuous ceiling 8 or other wall which is exposed to a room 10 and further serves to isolate the room 10 from the space or plenum 12 that is occupied by the framing members 2. The runners 6, on the other hand, support the sheets 4 along their longitudinal side edges, and further serve as a backing for the seams S along those edges. Although it is not essential for purposes of the present invention, the partition structure A when it is used to support the ceiling 8 may also include- —and indeed in most instances will include—some type of overlying deck 16 which rests on the framing members 2 and serves as the floor for a room above or perhaps as a roof for the building in which the partition structure A is located. Being behind the seams S at the edges of the sheets 4, the runners 6 block those seams, even when they are otherwise open and exposed. By supporting the sheets 4 along their longitudinal sides, the runners 4 further preserve the structural integrity of the wallboard sheets 4, even after they have been subjected to intense heat and as a result have shrunk and withdrawn from one another.

Considering the partition structure A in somewhat more detail, the framing members 2 (FIGS. 1 & 2) may be simple wood joists or more complex wood trusses, or they may be so-called wood I-beams. Irrespective of what type of wood product they constitute, each has upper and lower surfaces that are of wood constituency, and are thus capable of accepting and retaining nails or wood screws that are driven into them. The framing members 2 within a given area are of the same height so that their upper surfaces lie in one plane—the plane of the deck 16—and their lower surfaces lie in another plane—the plane of the ceiling 8. Indeed, the lower surfaces are in fact mounting surfaces to which the wallboard sheets 4 of the ceiling 8 are attached. In the case of a typical joist the upper and lower surfaces are flat and have a nominal width of 2 inches or in the case of a truss may have a nominal width of 4 inches, depending on the direction in which the members are oriented in the truss. The framing members 2 may also be made of steel which, while not being combustible in the sense that wood is, nevertheless lose its strength at elevated temperatures and thus must be insulated from the intense heat of a fire. Irrespective of their composition and construction, the framing members 2 are set on bearing surfaces at uniform centers, typically on the order of 16 or 24 inches, and extend parallel to each other.

The sheets 4 of wallboard are a conventional building material consisting of nothing more than a gypsum core encased in a paper cladding, the typical thicknesses being $\frac{3}{8}$, $\frac{1}{2}$, and $\frac{5}{8}$ inches. Wallboard is normally supplied in 4 foot widths, with the lengths varying generally in multiples of two feet, such as 8, 10, 12, 14 or 16 feet.

Figure 2:
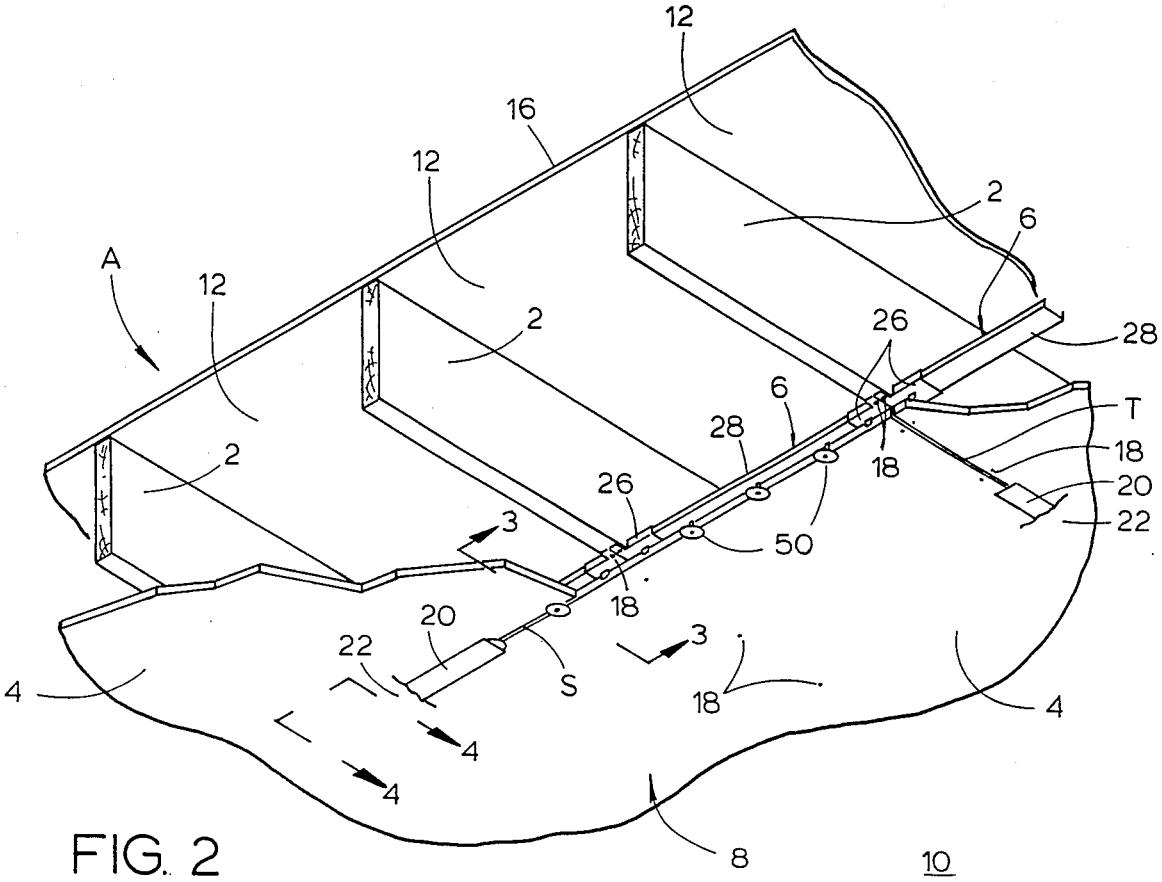
FIG. 2 is a perspective view showing the underside of the partition structure with its ceiling being broken away.

The sheets 4 extend transversely with respect to the framing members 2 and as such each sheet crosses several framing members 2, the upper face of the sheet 4 being directly against the lower surfaces of the structural members 2 that it crosses (FIG. 2). Indeed, each sheet 4 is attached to each of the structural members 2 beneath which it lies, this attachment being effected by fastening devices 18, such as wallboard nails or wallboard screws, that pass through the sheet 4 and into the framing members 2. The fastening devices 18 should be set about 8 to 12 inches apart. Preferably the sheets 4 are long enough to pass from one end of the room 10 to the other, but where the room 10 is longer than the sheets 4, two sheets 4 are brought together end-to-end at a transverse butt joint T which lies beneath and is centered with respect to one of the framing members 2. Here the sheets 4 are attached to the single framing member 2 by fastening devices 18 which pass through them slightly inwardly from the transverse joint T at which they abut.

The sheets 4 are of course set side-by-side across room 10, thus forming the longitudinal seams S along the side edges of adjacent sheets 4. Each sheet 4 along its side edges is tapered slightly with the taper being quite gentle and almost imperceptible. The tapers create slight depressions along the longitudinal seams S, that is to say, each seam S is at the center of a downwardly opening depression that runs the length of ceiling 8.

Actually, the seams S are obscured by a tape 20 which is embedded in a joint cement 22 along the seam S such that the tape 20 and joint cement 22 fill the depression and produce a flat surface on the ceiling 8. The butt joints T are also covered with tape 20 and joint cement 22 to obscure them. The result is a continuous ceiling 8 formed from a plurality of wallboard sheets 4.

The runners 6 extend between the framing members 2 (FIGS. 1 & 2), each being attached at its ends to the two members 2 between which it extends. The downwardly presented surfaces of the runners 6 lie flush with the lower surfaces of the framing members 2, and thus the back faces of the wallboard sheets 4 are also against runners 6. Moreover, the runners 6 are centered with respect to the seams S along which they lie to create fire blocks or stops along those seams S. Being about as long as the space between two structural members 2, the runners 6 are easily manipulated and are installed and fastened to the members 2 as the wallboard sheets 4 are hung, with each runner 6 being fitted against the side edges of one of th sheets 4 it backs before the adjacent sheet 4 is hung. In this regard, the runners 6 are self-locating so little effort is required to achieve a centered position with respect to the seams S along which they lie.

Figure 5:
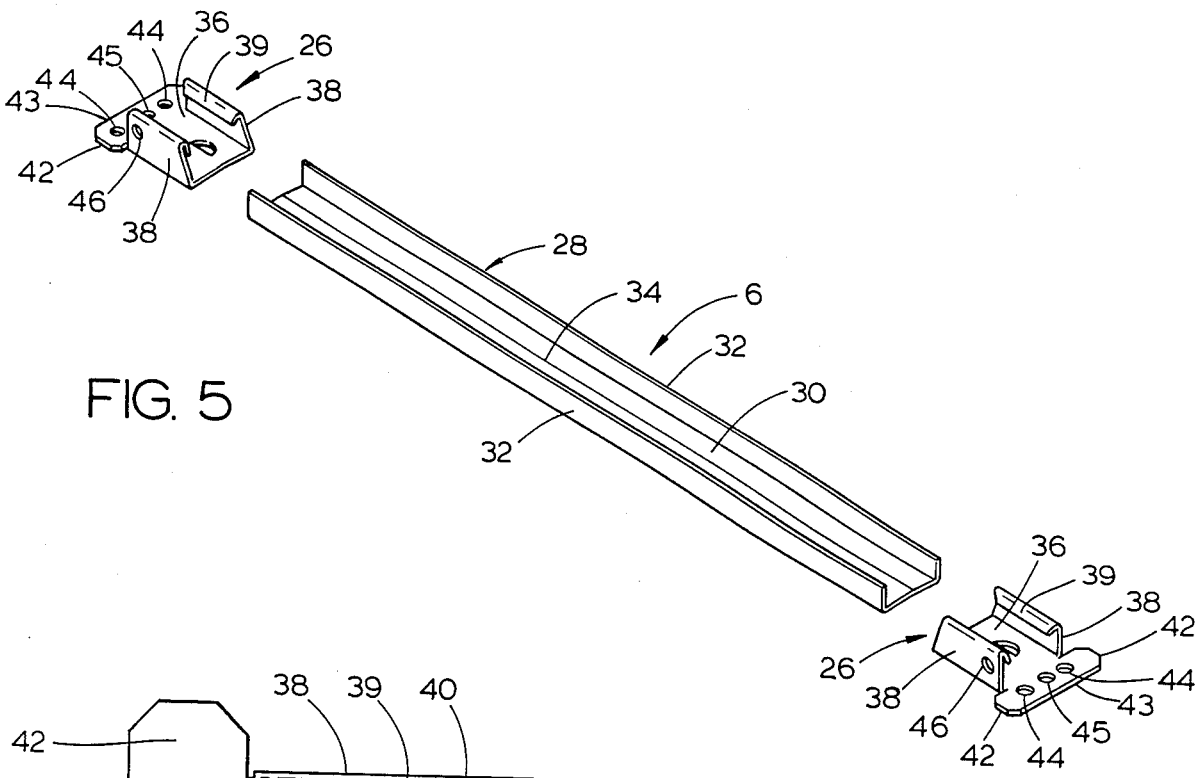
FIG. 5 is an exploded perspective view of a runner forming part of the present invention.
Figure 6:
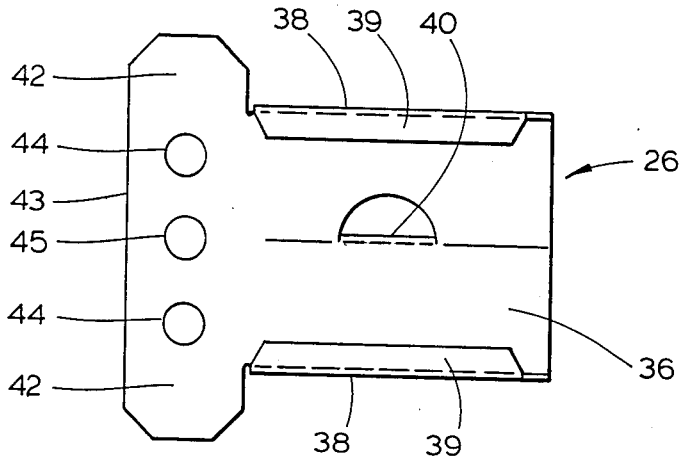
FIG. 6 is a plan view of one of the end brackets for the runner.

Each runner 6 consists of (FIG. 5) a pair of end brackets 26 and a connecting channel piece 28 that is extended between the brackets 26, yet telescopes or slips relative to them so that the length of the runner 6 may be altered. Considering the channel piece 28 first, it as its name implies possesses a channel-shaped configuration formed by a horizontal cross or bottom wall 30 and two side walls 32 that turn upwardly with respect to the bottom wall 30. The bottom wall 30 is slightly depressed, perhaps no more than about 1/32 inch, intermediate the two side walls 28, and indeed has a slight crease 34 extending its full length. The crease 34 aligns with and lies directly behind the seam S that separates the two wallboard sheets 4 which are backed by the runner 4.

Figure 4:
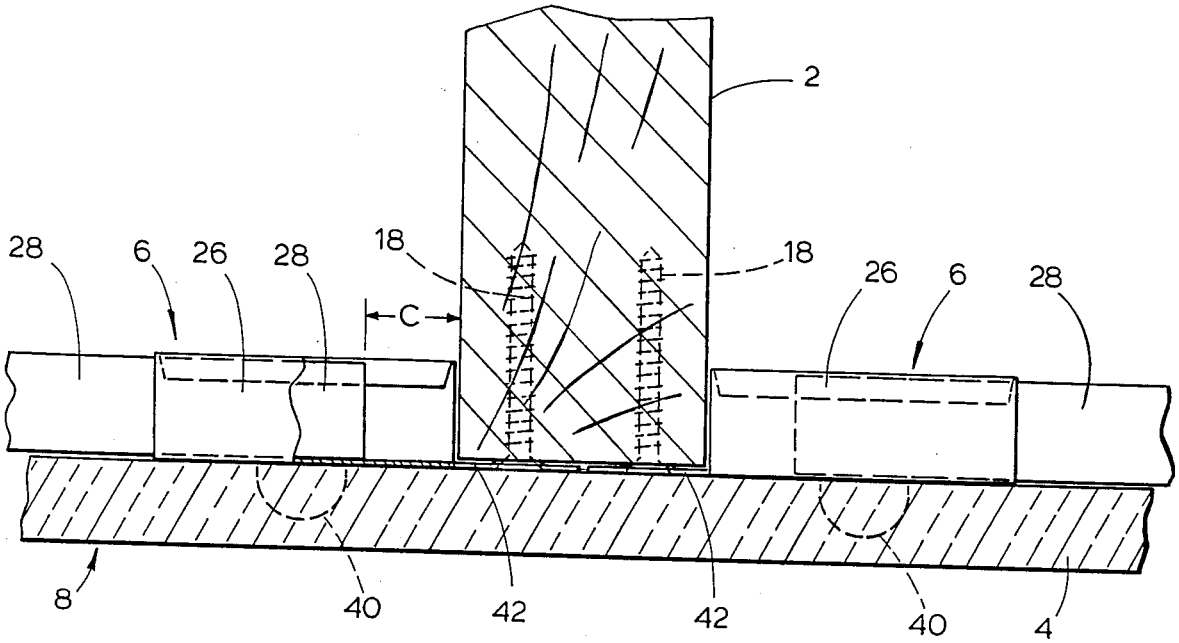
FIG. 4 is a sectional view taken along line 4—4 of FIG. 2 and showing the runners fitted against and extending away from a framing member with one of the runners being broken away to show the clearance between the end of its channel and framing member to which it is attached.

The channel piece 28 is formed from a noncombustible substance that will not corrode. Galvanized sheet steel, which is no thinner than about 30 gage, will suffice. At the bottom wall 30, the width of the channel piece 28 is typically $1\frac{1}{4}$ inches, while its length should be slightly less than the spacing between the opposed side faces of adjacent framing members 2. Indeed, the channel piece 28 actually fits into the space or plenum 12 between the two framing members 2 which the runner 6 bridges, there preferably being clearance c (FIG. 4) of about $\frac{1}{2}$ inches between each end of the channel piece 28 and the side face of the adjacent framing member 2.

Figure 7:
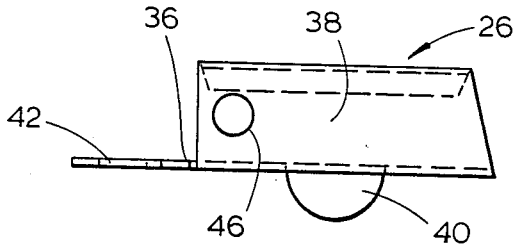
FIG. 7 is a side elevational view of the end bracket.
Figure 8:
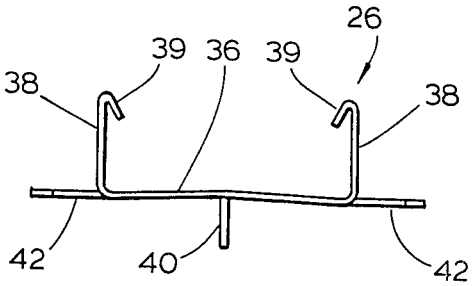
FIG. 8 is an end elevational view of the end bracket.

The end brackets 26 (FIGS. 5–8) are for the most part likewise of channel-shaped cross-section, each having a cross or bottom wall 36 and side walls 38 that turn upwardly at the sides of the bottom wall 36. The bottom wall 36 may be flat or creased and is just wide enough to accommodate the channel piece 28, which it does, so that the side walls 38 of the bracket 26 extend upwardly along the outside faces of the side walls 32 for the channel piece 28. Moreover, at the upper margins of its side walls 38, the bracket 26 turns inwardly over the upper edges of the side walls 32 for the channel piece 28 and then downwardly in the provision of retaining lips 39, which lie along the inside faces for the side walls 36 for the channel piece 28, thus preventing the end bracket 26 from moving laterally or vertically with respect to the channel piece 28. However, the fit between the end bracket 26 and the channel piece 28 is such that the latter will slide longitudinally over the former with relatively little effort, although the clearances between the two are not so great that the end bracket 26 will wobble on the channel piece 28. Midway between its two side walls 38 the end bracket 26 has a centering tab 40 (FIGS. 7 & 8) which is struck downwardly from the bottom wall 36 to lie parallel to the planes of the two side walls 38, it thus being generally perpendicular to the bottom wall 36 along the longitudinal centerline of the bottom wall 36. The depth of the centering tab 40, that is to say the distance that it projects downwardly from the bottom wall 30, is less than the thickness of the wallboard sheets 4.

The bottom wall 36 extends the full length of the end bracket 26, but the side walls 38, while extending out to one end of the bracket 26, terminate short of the other end. Here the bracket 26 has mounting tabs 42 (FIGS. 5–8) which flare outwardly from the bottom wall 36 and project beyond the side walls 38. The mounting tabs 42 are formed integral with the bottom wall 36 and lie flush with it, that is in the same plane, so for all intents and purposes the mounting tabs 42 are part of the bottom wall 30. Moreover, the width of the mounting tabs 42 should be about one-half or less of the thickness of the framing member 2. Actually, the two mounting tabs 42 and the portion of the bottom wall 30 which is between them constitute a flat mounting segment 43 that fits against the bottom surface of a framing member 2 to provide a location at which the bracket 26, and the runner 6 of which it forms a part, may be secured to the framing member 2. To this end the mounting segment is provided with spaced apart holes 44,there being one hole 44 to each side of the longitudinal centerline for the bracket 26. The holes 44 are large enough to accommodate the shank of a fastening device 18, but not the head. Even so, they should be large enough to permit the head of a wall board screw to sink into them and into the wood of the framing member 2 beyond, so that when the fastening device 18 is such a screw, its head will generally speaking lie flush with the exposed surface of the bracket 26. In addition, the mounting segment 43 has a center hole 45 which is aligned transversely with respect to the holes 44, but lies along the longitudinal centerline of the bracket 26. In its side walls 38, the bracket 26 has two more holes 46, these being close to the ends that are at the mounting tabs 42.

Like the channel piece 28, the end pieces 26 are formed from a noncombustible substance, preferably galvanized sheet steel that need be no thicker than 30 gage. Typically the side walls 38 are about 2 inches long, while the mounting tabs 42 are about $\frac{3}{4}$ inches wide, thus giving the entire bracket a length of about $2\frac{3}{4}$ inches. At the side walls 38 it is only slightly wider than the channel piece 28, which is $1\frac{1}{4}$ inches wide, whereas at the mounting tabs 42 it is about $1\frac{3}{4}$ inches wide, each tab 42 projecting beyond the side walls 38 by about $\frac{1}{4}$ inch.

Figure 11:
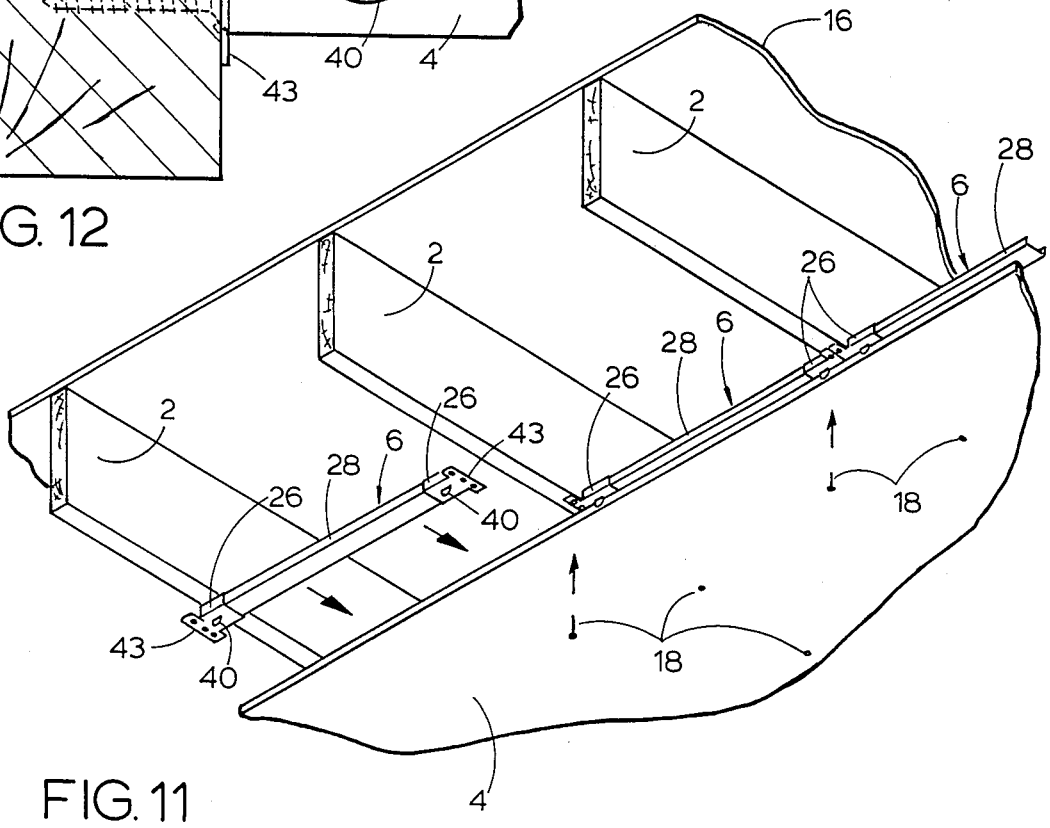
FIG. 11 is a perspective view showing a runner being installed after a wallboard sheet has been secured to the framing members.

Each runner 6 is installed in the partition structure A after one of the wallboard sheets 4 along which it is to be positioned is hung—or at least partially hung (FIG. 11). In this regard, in order to place the runner 6 halfway behind the sheet 4, the sheet 4 cannot be attached to the framing members 2 along or near that edge at which the runner 6 is to be fitted, because the wallboard 4 at that edge must be deflected downwardly slightly to enable the mounting tabs 42 on the end brackets 26 for the runner 6 to fit between the lower surfaces of the framing members 2 and the back face of the sheet 4. As the runner 6 is maneuvered behind sheet 4, its end brackets 26 are slipped outwardly until the ends of the side walls 36 on those brackets 26 are generally against the side faces of the framing members 2. With the brackets 26 so positioned, the runner 6 is urged further laterally until the centering tabs 40 on its end brackets 26 come against the side edge of the sheet 4. This locates the runner 6 correctly with respect to the sheet 4 and the two framing members 2, yet leaves a hole 44 exposed in each bracket 26, and those holes are of course directly below the framing members 2. A fastening device 18 is inserted through each exposed hole 44 and driven into the overlying framing member 2 to secure the runner 6 to the framing members 2. Enough runners 6 are installed in the foregoing manner to back the entire side edge of the sheet 4. Thereafter, more fastening devices 18 are driven through the sheet 4 to secure it to the framing members 2 adjacent to the side edge along which the runners 6 are located.

The other sheet 4 is then installed on the framing members 2 in the usual manner, it being brought up against the framing members 2 and maneuvered laterally until its side edge is along the side edge at which the partially exposed runners 6 are located. As the detached sheet 4 moves against the previously hung sheet 4, it passes under the exposed and secured mounting tabs 42 on the end brackets 26, as well as under one-half of each of the channel pieces 28. That sheet 4 is then attached to the framing members 2 in the usual manner with more fastening devices 18. The centering tabs 40 on the end brackets 26 of the runner project between the adjacent side edges of the two sheets 4 and create a slight separation which is in effect the longitudinal seam S.

Figure 9:
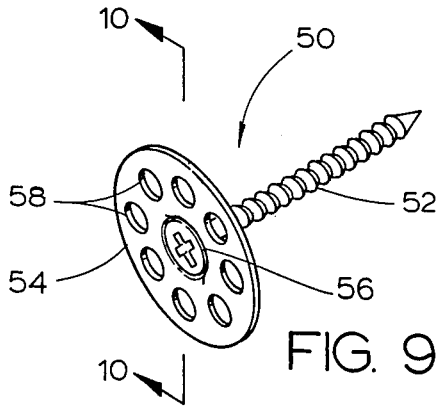
FIG. 9 is a perspective view of one of the edge fasteners.
Figure 10:
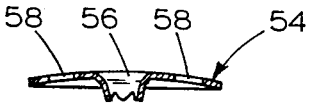
FIG. 10 is a sectional view taken along line 10—10 of FIG. 9 and showing the disk of the edge fastener.

Not only do the runners 6 function as fire stops along the seam S, but they also serve to support the sheets 4 along their side edges. To this end, edge fasteners 50 (FIGS. 3 & 9) are attached to the runners 6 at intervals corresponding to the spacing between the fastening devices 18, which is on the order of 8 to 12 inches, and these devices support the wallboard sheets 4 such that they keep the sheets 4 from falling or drooping downwardly, but do not prevent them from shrinking laterally. Each edge fastener 50 consists of a screw 52 and a disk 54 through which the screw 52 passes. The screw 52 may be a conventional wallboard screw or a sheet metal screw, for it must penetrate and thread into the bottom wall 30 of the channel piece 28. It should have a flat head of the countersink variety, and accordingly the head leads into the threaded shank along a beveled or conical surface. The disk 54, which is circular and slightly cup-shaped. Also in line 23, in configuration, it being in effect a circular plate, has at its center a countersunk hole 56 (FIG. 10) which opens downwardly and is large enough to receive the head of the screw 52 without having the head protrude beyond the lower surface of the disk 54. That surface is slightly convex. Moreover, around the countersunk hole 56, the disk 54 has a series of surrounding holes 58 (FIG. 9) which allow joint cement 22 to pass through the disk 54.

The disk 54 should be formed from a reasonably strong material that is non-combustible and noncorrosive. Galvanized steel sheet no thinner than about 30 gage will suffice. The disk 54 should range between ¾ and 1½ inches in diameter and should be preferably 1¼ inches.

Figure 3:
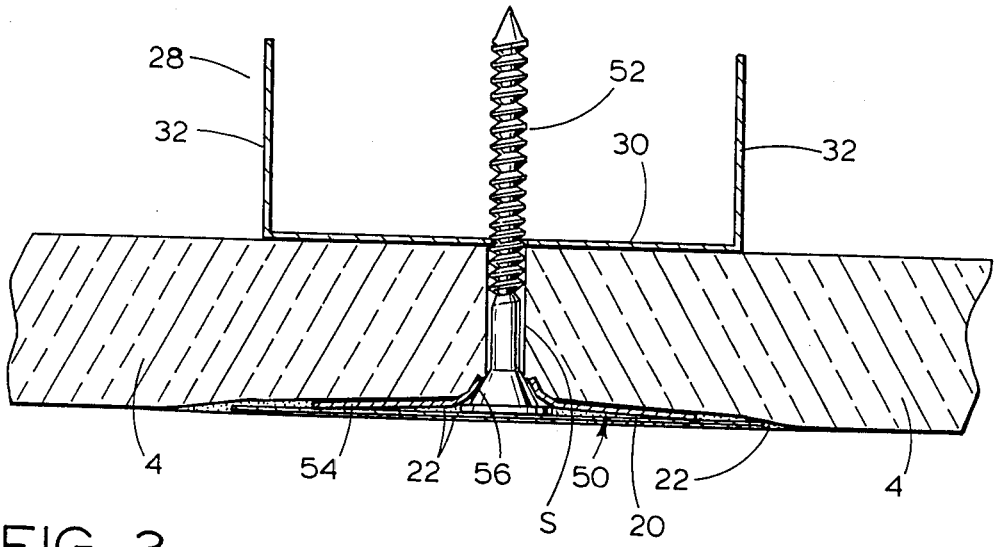
FIG. 3 is a sectional view taken along line 3—3 of FIG. 2 and showing one of the edge fasteners anchored in a runner and holding wallboard sheets against the runner.

The screw 52 passes through seam S between two wallboard sheets 4 and threads into the bottom wall 30 of the channel piece 28 behind that seam (FIG. 3). The disk 54 on the other hand, underlies the downwardly presented surfaces of the two sheets 4 along the edges that form the seam S between the two sheets 4. As the screw 52 is tigthened down, it draws the disk 54 snugly against sheets 4 and the disk 54 in turn suspends the sides of the sheet from the runner 6. Even so, the grip is not so tight as to prevent the wallboard sheets 4 on each side from pulling away from the screw 52 that holds the disk 54 in place—and indeed pulling away without undergoing disintegration of the sheet 4. The disk 54, being quite thin, lies entirely within the depression formed by the tapers at the side edges of the sheets 4, and here it is embedded within the joint cement 22 and covered by the tape 20 which obscures the seam S. Indeed, the surrounding holes 58 in the disk 54 allow the joint cement 22 to penetrate the disk 54 and adhere to the surface of the wallboard sheets 4 behind the disk 54. Since the disk 54 is convex, its peripheral edge bears against the downwardly presented surfaces of the two sheets 4 at which it is located, thus insuring that the disk 54 does not impart a noticeable protuberance to the tape 20 which covers it.

The joint cement 22 not only bonds to the downwardly presented surfaces of the sheets 4, but also finds its way into the space or seam S between the edges of the sheets 4, this space being the result of the slight separation created by the centering tabs 40 which project into the seam S. Indeed, the joint cement 22 if applied forcefully enough may even work its way completely through the seam S and spread over the top of the sheets 4 in the space created by the crease 34 along the channel piece 28. Irrespective of whether the cement 22 passes merely into the seam S or completely through and beyond the seam S, the joint cement 22 does key into the seam S and thus is more securely adhered than if it merely bonded to the downwardly presented faces of the sheets 4.

To summarize the procedure for installing the ceiling 8, a sheet 4 of wallboard is brought up to the lower surfaces of the framing members 2 and secured to those framing members 2 by driving the fastening devices 18 through the sheet 4 and into the framing members 2 (FIG. 11). At least one of the edges of the sheet 4 will be exposed, and along this edge the sheet 4 is left unsecured, that is free of fastening devices 18, so that the edge may be deflected downwardly, perhaps as much as ⅛ inches. Next, the runners 6 are installed along the exposed edge of the sheet 4, there being a separate runner 6 for each space of the plenum 12 traversed by the sheet 4. In other words, to each framing member 2 where the sheet 4 is attached, a runner 6 is likewise attached, and that runner 6 in effect bridges the space between two adjacent framing members 2.

To install any runner 6, that runner is merely raised to the edge of the sheet 4 and its end brackets 26 are slipped outwardly over the channel piece 28 until they are far enough apart to extend to and under the framing members 2 along their mounting tabs 42. Then, with the tabs 42 for the two brackets 26 being against the lower surfaces of the framing members 2, and with the side walls 38 for the brackets 26 as well as the side walls 32 of the channel piece 28 being between the opposed side surfaces of the two framing members 2, the mounting tabs 42 that are presented closest to the exposed edge of sheet 4 are manuevered behind the sheet 4 at that edge so as to be interposed between the back face of the sheet 4 and the lower surfaces of the framing members 2. At the same time the end brackets 26 are manipulated to bring the ends of their side walls 38 against the opposed side faces of the framing members 2. The runner 6 is shifted laterally until the centering tabs 40 on its end brackets 26 come against the side edges of the sheet 4. This positions the runner 6 such that the crease 34 along the center of its channel piece 28 is directly above and precisely aligned with the edge of the sheet 4. Fastening devices 18 in the form of nails or screws are then inserted through the holes 44 in the exposed portion of the bottom wall 36 and are driven into the framing members 2, thus securing the runner 6 to the two framing members 2 between which it extends. Additional runners 6 are installed in the remaning spaces of the plenum 12 along the edge of the sheet 4. More fastening devices 18 are now driven through the sheet 4 and into the framing members 2 near that edge of the sheet 4 at which the runners 6 exist, so as to bring the sheet 4 at that edge up tightly against the members 2 and those mounting tabs 42 which are behind the sheet 4.

Figure 12:
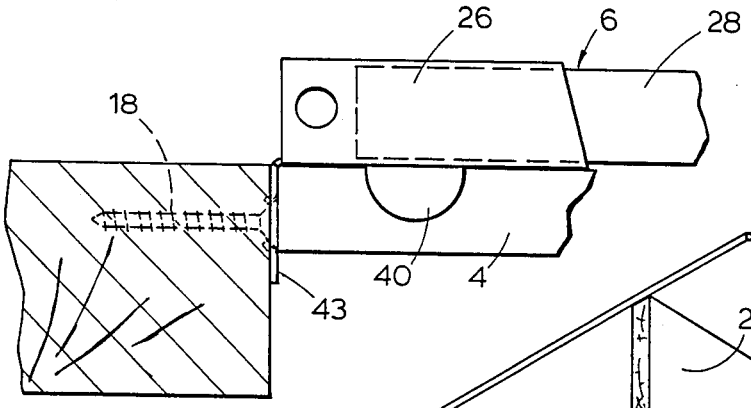
FIG. 12 is a side elevational view of a runner with its end bracket being configured to attach to a vertical surface.

Should the channel piece 28 of any runner 6 be too long for the space between the two framing members 2 to which that runner 6 is to be attached, one of the end brackets 26 is merely slipped over the channel piece 28 until the excess portion of the channel piece 28 projects beyond the bracket 26. Then the channel piece 28 is cut off to provide it with the appropriate length, and the end bracket 26 is slipped back over the cut to again project beycnd the channel piece 28.

Where there is no framing member 2 to which the end bracket 26 of the last runner 6 may be secured, but instead a vertical surface, such as may exist at the end of the room 10, the mounting segment 43 for the bracket 26 may be bent downwardly and fastened against the vertical surface (FIG. 12). Again the end bracket 26 is secured with a fastening device 18, but the device 18 is inserted through the center hole 45 in the mounting segment 43, instead of one of the holes 44. This tends to keep the bracket 26 and its runner 6 from twisting. The vertical surface may be the side face of a plate extending over wall studs.

Once the first wallboard sheet 4 is hung and the runners 6 placed along its side edge, another wallboard sheet 4 is lifted to the framing members 2 and shifted laterally until its side edge abuts against the side edge of the previously hung sheet 4. Still more fastening devices 18 are driven through this sheet 4 and into framing members 2 to hold it in place. Actually, the second sheet 4 when shifted laterally comes against the centering tabs 40 on the end brackets 26 of the runners 6, so that the tabs 40 tend to space the sheets 4 slightly apart. In any event, when the second sheet 4 is in place, a longitudinal seam S exists in the ceiling 8 between the two sheets 4, and along this seam S the runners 6 overlie the back or upper faces of the two sheets 4, creating a noncombustible fire stop or block along the seam S.

Additional sheets 4 and runners 6 are hung in a like manner until the full ceiling 8 is in place.

Once two sheets 4 of wallboard are secured to the framing members 2 with the runners 2 along the seam S that is between them, the edge fasteners 50 are installed along the seam S to attach the two sheets 4 to the runners 6 as well. As to each fastener 50 this involves nothing more than inserting its screw 52 through its disk 54, with the disk 54 of course oriented properly with respect to the screw 52, and then inserting the screw 52 into the seam S. With a suitable driver that is preferably power operated, the screw 52 is then forced upwardly and turned. By reason of the crease 34 in the bottom wall 30 of the channel piece 28, the screw 52 tends to remain along the seam S notwithstanding its rotation and does not skew to one side or the other. The screw 52 pierces the bottom wall 30 of the channel piece 28 and threads into that wall. Indeed, the screw 52 is run down until the disk 54 bears snugly, but not tightly, against the bottom surfaces of the two sheets 4. More edge fasteners 50 are placed at suitable intervals along the seam S in the same manner.

Once the edge fasteners 50 are emplaced, the seams S are taped in the usual manner. This involves nothing more than applying a layer of joint cement 22 over the bottom surfaces of the two sheets 4 along the seam S and then embedding a layer of tape 20 in the joint cement 22. More joint cement 22 is then applied over the tape 20. The disks 54 likewise embed in the first layer of joint cement 22 which indeed passes through the holes 58 within them to adhere to the surfaces of the sheets 4. The tape 20 and joint cement 22 completely cover and obscure the disks 54, making them totally imperceptible.

Should a fire of substantial proportions develop within the room 10, the intense heat will of course rise to the ceiling 8 and indeed the flames could well lap against the ceiling 8. In any event, the heat will most likely loosen the joint cement 22 and cause it and the tape 20 to fall from the wallboard sheets 4, thus exposing the longitudinal seams S. The heat will further cause the gypsum of the wallboard sheets 4 to lose its water of hydration, and as a consequence the sheets 4 will shrink and pull away from each other at the seams S, sliding over the disks 54 of the edge fasteners 50 as they move. In short, the seam S will widen without the sheets 4 crumbling or disintegrating in the regions where they are supported with the edge fasteners 50. Notwithstanding the withdrawal of the sheets 4 from one another, the sheets 4 still remain supported along their edges, for the disks 54 of the edge fasteners 50 are quite wide and continue to overlap the sheets 4. Thus, the sheets 4 will along their edges remain against the runners 6. The runners 6 in turn continue to serve as a fire block or stop behind the opened seams S and thus, in contrast to conventional ceilings, retard the entry of the heated gases and flames into the plenum 10. This preserves the wood framing members 2.

While the runners 6 experience a considerable elevation in temperature which causes their channel pieces 28 to increase in length, the runners 6 will not bow downwardly and push the shrunken and weakened wallboard sheets 4 away from them and the framing members 2. Instead, the ends of the channel pieces 28 will merely slide in the fastened end brackets 26, thus keeping the runners 6 horizontal with the bottom walls 30 of their channel pieces 28 in the same plane as the lower surfaces of the framing members 2. In other words, even though the wallboard sheets 4 and runners 6 possess characteristics that cause them to work against each other in the event of a fire, that is the former shrinks while the latter expands, these characteristics, which might otherwise contribute to the distruction of the ceiling 8, are nullified, and the ceiling 8 remains in place to preserve the critical framing members 2 which lie behind it.

A partition structure constructed in accordance with the present invention has withstood a one hour fire test conducted in accordance with ASTM Standard E119.

In lieu of wood framing members 2, steel framing members may be used, and in that instance wires are employed to connect the end brackets 26 of the runners 6 to the joists, the wires passing through the holes 46 in the side walls 38 of the end brackets 26 and thence to the framing members or some other supporting device to which they may be secured. By keeping the ceiling 8 in place and the intense heat away from the steel framing members, the steel retains its strength.

Since the ceiling of a room in which a fire develops is usually the first part of the room to be consumed and thus fail, the present invention has been described in connection with the ceiling 8. However, the invention also has utility in connection with other types of partition structures such as Walls. In that case the framing members constitute the studs.

This invention is intended to cover all changes and modifications of the example of the invention herein chosen for purposes of the disclosure which do not constitute departures from the spirit and scope of the invention.

What is claimed is:

1. A partition structure for a building, said partition structure comprising: framing members having mounting surfaces; at least two wallboard sheets attached to and supported on the framing members against the mounting surfaces thereof so as to generally obscure the mounting surfaces, with the sheets having side edges located in close proximity to each other to form a seam; and runners attached to the framing members at the seam, each runner extending from one framing member to the next behind the seam so that it projects laterally beyond the seam in both directions, each runner having an outwardly presented surface that lies generally flush with the mounting surfaces of the two framing members between which it extends and is generally against the wallboard sheets which create the seam at the runner, each runner including at least two pieces which are capable of sliding easily relative to each other generally parallel to the seam so that the length of the runner will not change appreciably as the runner experiences variations in temperature.

2. A partition structure according to claim 1 and further comprising fasteners attaching the wallboard sheets to the runners.

3. A partition structure according to claim 2 wherein each fastener passes between the sheets at the seam and further projects laterally beyond the seam to overlap the sheets and keep the sheets from pulling away from the runner to which the fastener attaches it.

4. A partition structure according to claim 3 wherein each fastener includes a plate which projects beyond the seam at which the fastener is located to overlap the sheets at their adjacent edges and a screw which extends through the plate and through the seam at the adjacent edges of the sheets, and beyond the sheets threads into the runner.

5. A partition structure according to claim 1 wherein the runner includes means for centering it with respect to the seam behind which it lies.

6. A partition structure according to claim 5 wherein the means for centering is at least one tab which projects into the seam.

7. A partition structure according to claim 1 wherein each runner includes an end bracket at each of its ends, with the end brackets being configured to fit against the framing members between which the runner extends, and a connecting piece extending between and connecting the end brackets, the connecting piece being capable of sliding with respect to at least one of the end brackets.

8. A partition structure for a building, said partition structure comprising: framing members; at least two wallboard sheets attached to and supported on the framing members, with the sheets having side edges located in close proximity to each other to form a seam; and runners attached to the framing members at the seam, with each runner extending from one framing member to the next behind the seam, each runner including an end bracket at each of its ends, with the end brackets being configured to fit against the framing members between which the runner extends, and a connecting piece extending between and connecting the end brackets, the connecting piece being capable of sliding with respect to at least one of the end brackets so that the length of the runner will not change appreciably as the runner experiences variations in temperature, the connecting piece having a cross wall and side walls and each end bracket having a cross wall and side walls which lie along and parallel to the cross wall and side walls, respectively, of the connecting piece, such that the cross walls of the brackets and the connecting piece lie in essentially the same plane, each end bracket further having a mounting segment that lies generally in the plane of its cross wall, so that when the mounting segments of the end brackets are attached against corresponding surfaces on the framing members, the cross walls of the end brackets and the connecting piece will lie in a plane that includes the corresponding surfaces of the framing members, the wallboard sheets being against the cross walls of the end brackets and the connecting piece.

9. A partition structure according to claim 8 wherein the cross wall of the connecting piece has a crease extending longitudinally in it midway between the side walls, with the crease forming a depression in that surface of the cross wall that is presented toward the sheets and being aligned with the seam between the sheets.

10. A partition structure according to claim 8 wherein the end brackets further include centering tabs which project away from the cross walls midway between the side walls of the end brackets and further fit into the seam to locate the runner with respect to the sheets.

11. A ceiling structure for a building, said ceiling structure comprising: framing members having downwardly presented surfaces, at least two wallboard sheets attached to the framing members against the downwardly presented surfaces thereon such that the sheets generally obscure the downwardly presented surfaces, with the sheets having side edges which are in close proximity to form a seam between the sheets; runners extending between the framing members at the seams, each runner including mounting segments which are against the downwardly presented surfaces of the framing members between which it extends and are fastened to such framing members, each runner having a bottom wall which extends along and between its mounting segments and lies generally flush with the lower surfaces of the framing members, each runner having its bottom wall projecting laterally beyond the seam in two directions and being generally against the wallboard at the seam to form a fire stop behind the seam, each runner including components which are capable of easily sliding relative to each other parallel to the seam along which the runner lies; and fastening means for attaching the sheets along their edges to the runners.

12. A partition structure according to claim 11 wherein the bottom wall of at least one component of each runner has a tab projecting downwardly from it; and wherein the tab projects into the seam and locates the runner relative to the seam.

13. A partition structure according to claim 11 wherein the components of each runner are channel-shaped in cross-section, with each having not only the bottom wall, but side walls also; and wherein the side walls of the components are located in the plenum between the framing members to which the runners are attached.

14. A partition structure according to claim 11 wherein the fastening means comprises a screw and a plate through which the screw passes, the screw being extended through the seam and threaded into the bottom wall of the runner, the plate projecting laterally beyond the screw and being held by the screw against the lower face of each sheet so as to support the two sheets along their adjacent edges.

15. The partition structure according to claim 14 wherein the plate is circular and has a center hole and a plurality of holes surrounding the center hole, and wherein the screw of the fastening means passes through the center hole.

16. The partition structure according to claim 15 wherein the plate is slightly convex on its downwardly presented surface.

17. A partition structure according to claim 11 wherein the components of each runner include a pair of end brackets on which the mounting segments are located and a connecting piece which extends between the end brackets and is capable of sliding easily with respect to at least one of the end brackets in a direction parallel to the seam along which the runner extends, but not otherwise.

18. A partition structure according to claim 17 wherein the end brackets of each runner have tabs which project downwardly from those end brackets and into the seam to locate the runner relative to the seam.

19. A process for installing a wallboard ceiling on spaced apart framing members to better protect the framing members from a fire beneath the ceiling; said process comprising, attaching a first sheet of wallboard to the framing members such that it is against downwardly presented surfaces on such framing members; thereafter inserting a separate runner behind the wallboard sheet along the edge of that sheet in each space between adjacent framing members such that a portion of the runner lies behind the sheet and another projects beyond the edge of the sheet, the runner having components which are capable of sliding relative to each other generally parallel to the edge of the sheet so that the runner can be adjusted to accommodate the space between the two framing members; thereafter attaching each runner to the framing members between which it fits with a portion of the runner projecting beyond the edge of the first sheet; attaching a second sheet of wallboard to the framing members such that it is against the downwardly presented surfaces of those framing members and has an edge along and in close proximity to that edge of the first sheet along which the runners extend, whereby the runner also lies behind the second sheet and a seam exists between the sheets along their adjacent edges; and attaching the sheets along their adjacent edges at the seam to the overlying runners.

20. The process according to claim 19 wherein the step of attaching the sheets includes inserting a screw through seam and threading it into the runner to draw a plate up against the bottom surfaces of the sheets.

21. The process according to claim 19 wherein each runner has a flat mounting segment at each of its ends, and the step of inserting the runner includes placing the mounting segments against the lower surfaces of the framing members, and the step of attaching each runner includes inserting fastening devices through the mounting segments and into the framing members.

22. The process according to claim 19 wherein each runner includes at least one locating tab which projects downwardly from it intermediate its sides; and the step of inserting the runner includes moving the runner laterally until its tab comes against the edge of the first sheet.

23. In combination with a partition structure including at least two wallboard sheets which have edges in close proximity to each other along a seam and a backing member located behind the seam, an improved fastener for holding the wallboard sheets to the backing member, said fastener comprising: a disk having a countersunk hole in the region of its center, with the hole being located at the seam between the two wallboard sheets so that the disk overlaps the two sheets at the seam, the disk being slightly cup shaped when not stressed and being located along the seam with its convex surface presented away from the wallboard sheets so that the disk bears against the sheets along its peripheral margin; and a securing device extending through the countersunk hole in the disk and having a head which is located within the hole such that it does not protrude beyond that surface of the disk which is presented away from the wallboard sheets, the securing device being engaged with the backing member tightly enough to draw the disk at least at its peripheral edge tightly against the wallboard sheets; and a joint cement adhered to the wallboard along the seam, but generally not elsewhere, and completely covering and obscuring the disk and the head of the securing device.

24. The combination according to claim 23 wherein the disk further has a plurality of apertures located between its countersunk hole and peripheral margin and the joint cement extends through the apertures and adheres to the wallboard sheets at the apertures.

25. The combination according to claim 24 wherein the securing device is a screw.

* * * * *